United States Patent [19]

McSmith et al.

[11] Patent Number: 4,458,418

[45] Date of Patent: Jul. 10, 1984

[54] TUBING AND CABLE CUTTING TOOL

[75] Inventors: Dwight D. McSmith, Hampton; James I. Richardson, Newport News, both of Va.

[73] Assignee: The United States of America as represented by the Administrator of the National Aeronautics and Space Administration, Washington, D.C.

[21] Appl. No.: 309,292

[22] Filed: Oct. 6, 1981

[51] Int. Cl.[3] ..... B26B 15/00

[52] U.S. Cl. ..... 30/228; 30/180; 30/188; 30/191; 30/272 R; 30/249

[58] Field of Search ..... 30/180, 182, 186–188, 30/228, 175, 191, 241, 243–244, 249–250, 272 R, 258; 81/3.2, 177 F; 128/305, 309, 321, 318; 60/478; 254/93 H

[56] References Cited

U.S. PATENT DOCUMENTS

| | | | |
|---|---|---|---|
| 2,075,341 | 3/1937 | Goodman . | |
| 2,195,045 | 3/1940 | Bernay . | |
| 2,618,929 | 11/1952 | Bidin | 60/478 |
| 2,714,250 | 8/1955 | Twedt | 30/180 |
| 2,814,224 | 11/1957 | Allard | 81/177 F |
| 3,058,214 | 10/1962 | Mekler . | |
| 3,343,261 | 9/1967 | Richards | 30/258 |
| 3,409,983 | 11/1968 | Jamison | 30/228 |
| 3,482,613 | 12/1969 | Jordan . | |
| 3,806,091 | 4/1974 | Wride | 254/93 R |
| 4,057,897 | 11/1977 | Seymour . | |
| 4,224,739 | 9/1980 | Emblidge | 30/249 |

*Primary Examiner*—Frederick R. Schmidt
*Assistant Examiner*—Debra S. Meislin
*Attorney, Agent, or Firm*—Wallace J. Nelson; John R. Manning; Howard J. Osborn

[57] ABSTRACT

This invention relates to a hand held hydraulic cutting tool particularly useful to deactivate ejection seats in military aircraft rescue operations. The tool consists primarily of a hydraulic system composed of a fluid reservoir 11, a pumping piston 16, and an actuator piston 26. Mechanical cutting jaws 28, 29 are attached to the actuator piston rod 26. The hydraulic system is controlled by a pump handle 18. As the pump handle 18 is operated the actuator piston rod 26 is forced outward and thus the cutting jaws are forced together. The frame of the device is a flexible metal tubing 30 which permits easy positioning of the tool cutting jaws in remote and normally inaccessible locations. Bifurcated cutting edges 28*a* and 28*b* ensure removal of a section of the tubing or cable (40, FIG. 3) to thereby reduce the possibility of accidental reactivation of the tubing or cable being severed.

6 Claims, 4 Drawing Figures

TUBING AND CABLE CUTTING TOOL

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

This invention relates to a hand held hydraulic cutting tool. This tool in its disclosed form was developed to be used to deactivate ejection seats in military aircraft during emergency rescue operations. Prior to this invention, a manually operated cutting tool was used. This mechanical tool has long handles which are necessary to provide sufficient torque to the cutting jaws and the use of both hands is required for operation. The present invention employs a trigger grip handle that can easily be operated with one hand due to the mechanical advantage gained by the use of a hydraulic system. Another advantage of the present invention is that its frame is flexible and thus can be manipulated so that a cutting operation can be performed in a cramped location. The previously used mechanical tool had a rigid body and was difficult to use in many instances.

Although various hydraulic cutting tools presently exist, none are suitable for the purpose for which the present invention was designed. The majority of existing tools are operated by a handle such that both hands are required to use the tool. The existing tools have either a solid metal frame with no flexibility or a hydraulic hose with no rigidity. Also, the existing tools have single bladed cutting heads that make one cut through a tube or cable. In order for an ejection seat pressure supply line to be safely deactivated a section of the pressure supply line must be removed so there is no chance of accidental reactivation.

Accordingly, it is an object of the present invention to provide a lightweight hand-held cutting tool capable of removing a section of tubing or cable with one cutting operation.

Another object of the present invention is to provide a cutting tool having an erect and yet flexible frame to permit easy manipulation thereof.

Still another object of this invention is to provide a cutting tool that can be operated with one hand, freeing the other hand for balancing or for additional work.

Another object of the present invention is to provide a cutting tool that is fireproof and is safe for use in rescue operations in which the rescuer is prone to be exposed to fire.

Also, an object of the present invention is to provide a hydraulic cutting tool that is functional at any cutting angle or orientation.

Yet another object of the present invention is to provide a hydraulic cutting tool wherein the working fluid is automatically returned to the fluid reservoir upon opening a relief valve to thereby ready the tool for its next operation.

These and other objects of the invention are attained by the present invention by providing an elongated cutting tool having a hydraulic pump located at one end thereof and operable by a one-hand pumping motion, a cutting head at the other end including a hydraulic activated piston in fluid connection with the hydraulic pump for forcing a pair of cutting jaws towards each other and an elongated flexible "gooseneck" extension connecting the two ends together and permitting selective placement of the cutting head in an operative position spaced from the pump.

A more complete appreciation of the invention and many of the attendant advantages thereof will be better understood as the same becomes more apparent by reference to the following detailed description when considered in connection with the accompanying drawings, wherein:

Figure 1:
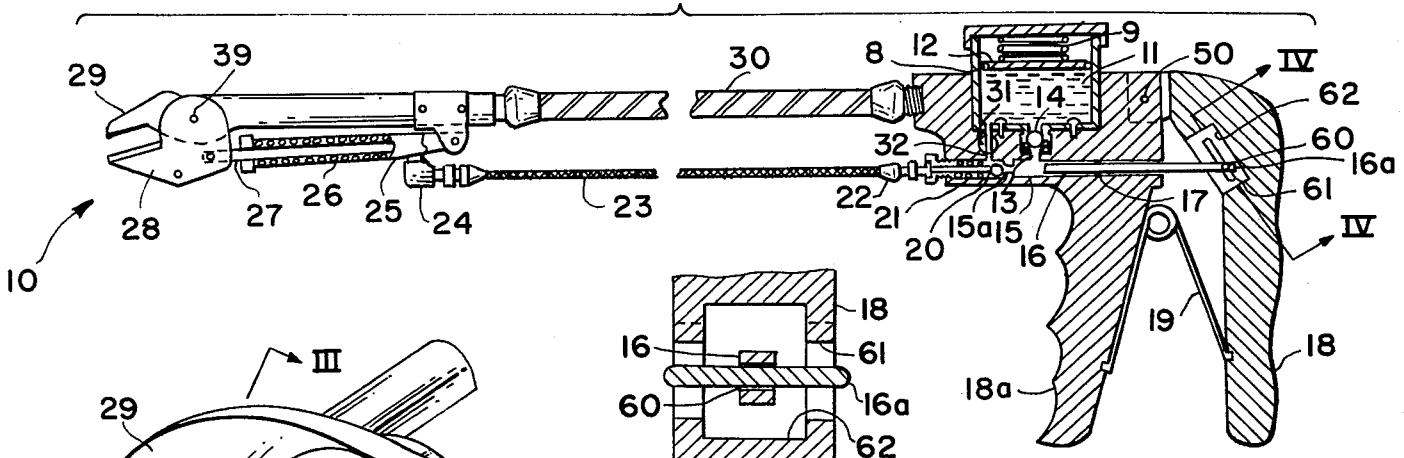
FIG. 1 is a partial cross-sectional view of the hydraulic cutter tool of the present invention, according to the present invention.
Figure 4:
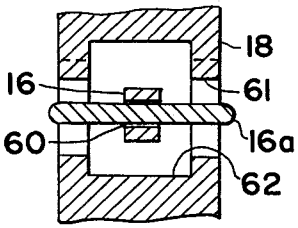
FIG. 4 is a sectional view taken along line IV—IV of FIG. 1.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose.

DETAILED DESCRIPTION OF THE INVENTION

Referring now to the drawings and more particularly to FIG. 1, the cable or shielded tubing cutting tool of the present invention is shown and generally designated by reference numeral 10. The individual components of the hydraulic system and the mechanical components of cutting tool 10 and the relationship of how these components fit together are illustrated in this FIG. As shown therein, a hydraulic fluid reservoir 11 is connected to a pumping piston cylinder 15 by a fluid transfer duct 13. A spring 9, a floating lid 12, and an "O"-ring 8 disposed about lid 12 are located in fluid reservoir 11. The "O"-ring 8 creates a seal between floating lid 12 and the reservoir wall thus preventing fluid flow between the upper and lower portions of the reservoir. Spring 9 maintains mild pressure on floating lid 12 which in turn keeps the fluid in the bottom of the reservoir and transfer duct 13 against ball check valve 14 making the tool functional at any orientation. Pumping piston 16 is operated in pumping piston cylinder 15 by pump handle 18 which is pivotally connected at pivot point 50 to grip **18*a* and spring loaded thereagainst by the pump handle return spring 19. Piston 16 is connected to rod 16*a* via eye 60. Rod 16*a* is loosely retained within cavity 61 extending through and transverse to hollow 62 of handle 18 to permit minimum friction therebetween while ensuring return along with piston 16 during each stroke of pump handle 18. Pumping piston cylinder O-ring seal 17 seals the working fluid in pumping piston cylinder 15. Pumping piston cylinder 15 is connected to actuator piston cylinder 25 by transfer duct 21 and transfer hose 23. A spring loaded ball check valve 20 is located in transfer duct 21. Fittings 22 and 24 connect transfer hose 23 to transfer duct 21 and actuator piston cylinder 25, respectively, in a conventional manner. A spring loaded actuator piston 26 operates in actuator piston cylinder 25. The actuator piston rod 27** is connected to the movable bifurcated cutting jaw 28. The movable cutting jaw 28 is pivotally connected to the stationary center cutting jaw 29 at pivot 39. A flexible tubing "gooseneck" extension 30 connects the stationary center cutting jaw 29 to the pump handle 18. A pressure relief duct 32 connects fluid resevoir 11 to transfer duct 21. A stopcock pressure relief valve 31 operates in the pressure relief duct 32.

Figure 3:
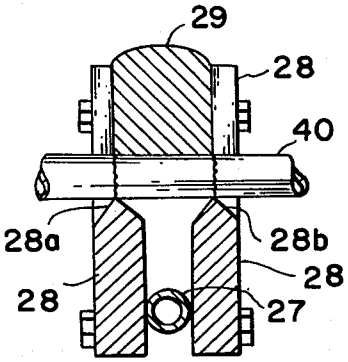
FIG. 3 is a sectional view of the cutting tool head taken along lines III—III of FIG. 2.
Figure 2:
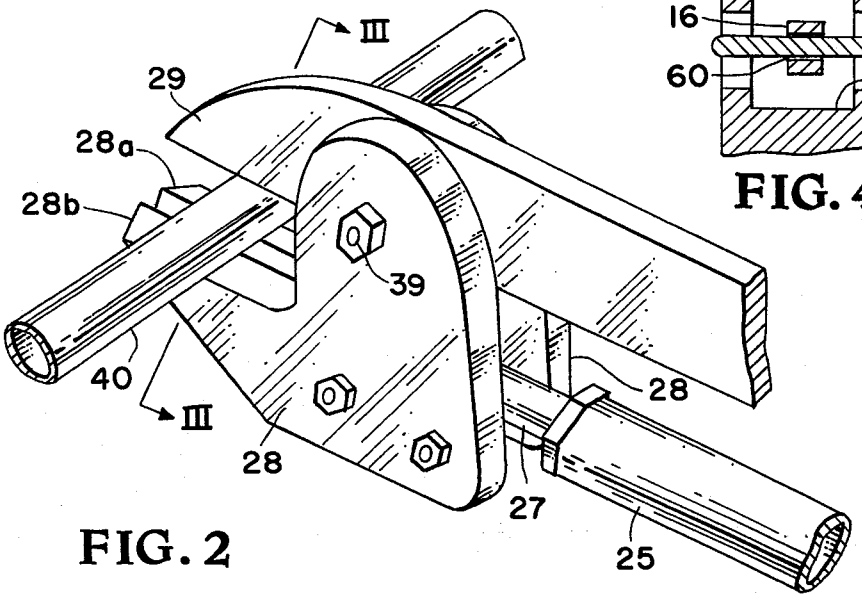
FIG. 2 is an enlarged perspective view of the cutting head of the cutting tool shown in FIG. 1.

The operation of this tool is as follows: At the beginning of a cutting cycle pumping piston 16 is in its fully retracted position, spring loaded ball check valve 14 is seated against fluid reservoir 11 preventing the flow of hydraulic fluid from reservoir 11 to transfer duct 13, spring loaded ball check valve 20 is seated against pumping piston cylinder opening 15*a* preventing the flow of fluid from pumping piston cylinder 15 to transfer duct 21, and pressure relief valve 31 is in the closed position thus preventing the flow of fluid between fluid reservoir 11 and transfer duct 21. The cycle is initiated as pump handle 18 is depressed thus forcing pnmping piston 16 into cylinder 15. This motion pressurizes the fluid which in turn forces ball check valve 20 open and the fluid flows into transfer duct 21. As the pump handle is released pump handle return spring 19 forces the handle 18 to original position as pumping piston 16 is retracted. This motion lowers the pressure in pumping piston cylinder 15. The lower pressure in pumping piston cylinder 15 allows the pressurized fluid in reservoir 11 to force ball check valve 14 away from the reservoir housing and thus allows a flow of fluid through transfer duct 13 into pumping piston cylinder 15. Thus, pumping piston cylinder 15 is again filled with fluid and the pumping cycle is ready to repeat. During each pumping cycle a quantity of fluid is forced through ball check valve 20 and through transfer duct 21 and transfer hose 23 into actuator piston cylinder 25. Ball check valve 20 prevents the flow of fluid back into pumping piston cylinder 15 once it is on the actuator piston side of said ball check valve. As each pumping cycle forces more fluid into actuator piston cylinder 25, actuator piston 26 is forced further outward, and thus movable cutting jaws 28 pivot about pivot pin 39 and are forced toward stationary center cutting jaw 29. The object to be cut (illustrated by tubing 40 in FIGS. 2 and 3) is placed between the sharp edges 28*a*, 28*b* of movable cutting jaw 28 and stationary center cutting jaw 29 and pump handle 18 is operated until jaws 28 have been forced toward stationary jaw 29 an adequate distance to sever a section from tubing 40 or other object being cut. Once the cutting operation is completed, pressure relief valve 31 is opened by a lever (not shown) located on the outside of pump handle 18. The pressure exerted by actuator piston 26 is greater than the pressure exerted by the spring 9 and floating lid 12 combination in fluid reservoir 11, and thus the pressure of the fluid in actuator piston 26 is forced back through fluid transfer hose 23 and transfer duct 21, and through pressure relief duct 32 back into fluid reservoir 11. Pressure relief valve 31 is then closed and tool 10 is ready for use in its next cutting operation.

In examining the operation of the cutting jaws 28 and 29 more closely (FIG. 3), it can be seen that the faces of movable cutter jaw 28 are beveled with the faces coming to an edge 28*a*, 28*b* at the inside of each prong of jaw 28. The face of stationary center cutting jaw 29 is flat. When the jaws clamp down on an object, each of the two movable cutting edges 28*a*, 28*b* makes a cut in the object and as a result a portion or segment of the object (tube or cable 40) is removed.

The advantages of the device are numerous and it is especially adapted for use on an aircraft ejector seat pressure supply line in rescue operations. The rescuing personnel must work in precarious positions while attempting to deactivate pressure supply lines that are located in hard to get to places. The present invention allows the rescuer to work with one hand, freeing his other hand to help balance himself or for other work. The cutting tool of the present invention should also be a useful addition to any rescue type operation, e.g., automobile accidents, fires and the like. The present invention has a flexible body that makes it easier to work in the hard to get to places, and the cutting head of the present invention allows the rescuer to complete his task in one quick cutting operation. The use of a hydraulic system in the present invention allows the rescuer to exert a greater amount of force then is possible with the mechanical device.

It is to be understood that the form of the invention shown and described herein is to be taken as a preferred embodiment. Although no specific dimensions have been mentioned, in a specific embodiment of the invention the overall length of tool 10 was 30 inches with cutting jaws 28 and 29 capable of opening sufficiently wide to cut tubing or cable of 0.75 inch thickness. Various changes may be made in the shape, size, and arrangement of parts without departing from the spirit or scope of the invention. For example, the hand pump unit can be replaced with a pressure vessel and operate with a "one-shot" valve. This and other modifications and variations of the present invention will be readily apparent to those skilled in the art in the light of the above teachings.

What is claimed as new and desired to be secured by Letters Patent of the United States is:

1. A cutting tool for severing and removing a linear section of an elongated object, comprising:

a one-hand activated pump including a fluid reservoir containing a working fluid and a transfer duct for receiving fluid from said reservoir as said pump is activated;

a cutting head spaced from said pump and including a flat surfaced fixed cutting jaw and a bifurcated cutting jaw having sharp edges on each bifurcation thereof, said fixed and said bifurcated cutting jaw being pivotally connected at a pivot point and adapted for relative movement about the pivot point;

an elongated flexible gooseneck type metal extension connecting said pump and said cutting head to permit positioning of the cutting head at diverse locations relative to said pump; and flexible transfer means for conveying the fluid pumped by said pump from said transfer duct toward said cutting head to actuate relative movement between said bifurcated jaw and said fixed jaw of said cutting head to effect severing and removal of a linear section of an elongated object transversely disposed between said jaws.

2. The cutting tool of claim 1 wherein said one-hand activated pump includes a pistol grip having a fixed portion thereof for grasping by the fingers of an operator and a handle portion for grasping by the thumb of an operator, said handle portion being pivotally attached to said fixed portion for relative pumping motion when said handle and said fixed portion are squeezed toward each other by the hand of the operator, spring means disposed between said fixed portion and said handle serving to return said handle to position after each pumping motion thereof when the operator relaxes the squeezing force, and pumping piston means movable by said handle upon each motion by said handle to pump fluid from said fluid reservoir into said transfer duct.

3. The cutting tool of claim 1 wherein said means for conveying the fluid pumped by said pump from said transfer duct toward said cutting head to actuate relative movement between said jaws includes an elongated fluid transfer hose in fluid communication with said pump and said cutting head and an actuator piston disposed in said cutter head and in fluid communication with said fluid transfer hose, said actuator piston being secured to said bifurcated cutting jaw for effecting a cutting motion thereof when influenced by fluid from said transfer hose, a return spring disposed around said actuator piston to cause reverse motion of said bifuracted cutting jaw when fluid pressure in said transfer hose is relaxed; and valve means disposed is said pump for selectively permitting pressure relaxation within said transfer hose, said valve means being disposed within a conduit connecting said fluid reservoir and said transfer hose.

4. A one-hand actuated hydraulic cutting tool for removing a linear section of a tube or cable located in cramped quarters comprising:

a hydraulic working unit including a working fluid, a fluid reservoir connected to a pumping piston cylinder by a transfer duct, a spring loaded ball check valve located in said transfer duct, a pumping piston slidably disposed in said pumping piston cylinder and attached to a one-hand operated pump handle means, said pumping piston cylinder connected to an actuator piston cylinder by a transfer duct and a flexible transfer hose in series, a spring loaded ball check valve located in said transfer duct, an actuator piston slidably disposed in said actuator piston cylinder and connected to a movable dual bladed cutting jaw, a stationary cutting jaw located adjacent to said movable cutting jaw, said movable and stationary jaw forming a cutting head, said stationary cutting jaw being attached to the pump handle means by an elongated flexible metal tubing frame means permitting selective placement of the cutting head in an operative position spaced from the pump handle means;

whereby when said pump handle means is operated the working fluid is forced from the fluid reservoir through the transfer ducts and flexible transfer hose into the actuator piston cylinder forcing the actuator piston outward and thus forcing the movable dual bladed cutting jaw toward the stationary cutting jaw to simultaneously make two cuts in the tubing or cable to be cut thereby removing a linear section thereof in one cutting operation.

5. A hand held hydraulic cutting tool as in claim 4 wherein the actuator piston is spring loaded whereby the working fluid is kept under pressure and means for selectively permitting reverse fluid flow such that it may be forced from the actuator piston cylinder back through the transfer hose and into the fluid reservoir after a cutting cycle.

6. A hand held hydraulic cutting tool as in claim 4 wherein a spring loaded floating lid is used to keep pressure on the fluid in the fluid reservoir whereby pressure is exerted on the ball check valve located in the transfer duct between the fluid reservoir and the pumping piston cylinder thus facilitating the valves opening upon operation of the pump handle, and means sealing said lid relative to said reservoir to prevent leakage therearound while permitting relative lid movement due to changes in fluid volume in said reservoir to thereby enable tool use at any orientation thereof.

* * * * *